US008397325B2

(12) United States Patent
Satou et al.

(10) Patent No.: US 8,397,325 B2
(45) Date of Patent: Mar. 19, 2013

(54) AIR CELL CUSHION

(75) Inventors: Hajime Satou, Kanagawa (JP); Toshimitsu Ebinuma, Kanagawa (JP); Yasunobu Seki, Kanagawa (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 98 days.

(21) Appl. No.: 12/856,798

(22) Filed: Aug. 16, 2010

(65) Prior Publication Data

US 2011/0041250 A1 Feb. 24, 2011

(30) Foreign Application Priority Data

Aug. 20, 2009 (JP) ..... 2009-190821

(51) Int. Cl.
*B68G 5/00* (2006.01)

(52) U.S. Cl. ..... 5/654; 5/710; 5/706; 5/713

(58) Field of Classification Search ..... 5/709, 706, 5/713, 727, 654
See application file for complete search history.

(56) References Cited

U.S. PATENT DOCUMENTS

| | | | | |
|---|---|---|---|---|
| 7,946,654 | B2 * | 5/2011 | Tsuber et al. | 5/654 |
| 2005/0066445 | A1 * | 3/2005 | Christofferson et al. | 5/654 |
| 2005/0120483 | A1 * | 6/2005 | Clapper | 5/654 |
| 2005/0177947 | A1 * | 8/2005 | Dorfler et al. | 5/655.3 |
| 2007/0011815 | A1 * | 1/2007 | Fraser et al. | 5/654 |
| 2007/0056112 | A1 * | 3/2007 | Graebe | 5/655.3 |
| 2007/0204406 | A1 * | 9/2007 | Thisse et al. | 5/655.3 |
| 2007/0277320 | A1 * | 12/2007 | Massmann | 5/654 |
| 2007/0283496 | A1 * | 12/2007 | Skripps | 5/654 |
| 2008/0196166 | A1 * | 8/2008 | Fraser | 5/654 |
| 2008/0216245 | A1 * | 9/2008 | Liners | 5/654 |
| 2009/0265857 | A1 * | 10/2009 | Habegger | 5/709 |
| 2010/0132120 | A1 * | 6/2010 | Koerlin et al. | 5/654 |

FOREIGN PATENT DOCUMENTS

| | | | |
|---|---|---|---|
| GB | 2241164 A | * | 8/1991 |
| JP | 2008-284163 | | 11/2008 |

* cited by examiner

*Primary Examiner* — Robert G Santos
*Assistant Examiner* — Brittany Wilson
(74) *Attorney, Agent, or Firm* — Lowe, Hauptman, Ham & Berner, LLP

(57) ABSTRACT

This air cell cushion has a pair of side air cells extending upwardly from the upper surface side of the base member at both end sides in the lateral direction of the base member. The side air cells have a larger front-rear direction size than in the lateral direction thereof. Also, each side air cell is configured to inflate outward in the lateral direction. By this, in a case in which the side air cells face the armrests of the wheel chair, when the side air cells are inflated outward in the lateral direction, the outer side surfaces of the side air cells abut against or become adjacent to the armrests.

8 Claims, 3 Drawing Sheets

AIR CELL CUSHION

RELATED APPLICATION

The present application is based on, and claims priority from, JP Application Number 2009-190821, filed Aug. 20, 2009, the disclosure of which is hereby incorporated by reference herein in its entirety.

BACKGROUND OF THE INVENTION (i) Field of the Invention

The present invention relates to an air cell cushion, for example, used in a situation in which it is mounted on the seating surface of a wheel chair.

(ii) Description of the Related Art

Generally, an air cell cushion comprises a cushion main body having a plate-like base member and plurality of air cells arranged in a horizontal direction and each bottom end side of the air cells are supported by the base member and each of the air cells extends upwardly from the upper surface side of the base member, and a cushion cover covers the cushion main body. The air cell cushion is mounted on a seating surface and supports a seated person.

In the air cell cushion, air cells are collapsed in a vertical direction by a person sitting on the cushion, and the seated person is supported softly. Also, to improve the effect of preventing pressure-ulcer on the buttocks of the seated person, there is a case to enlarge the air cells in the vertical direction. However, enlarging the air cells in the vertical direction allows the air cell to easily deform in the horizontal direction, and it does not provide the seated person on the air cells a stable position.

Also, to solve the above mentioned situation, in hospitals and etc., a folded towel or the like is inserted between the air cell group constructed by the air cells of the cushion main body and the cushion cover to regulate the air cells from deforming in the horizontal direction. However, in this case, it takes time to insert the towel.

SUMMARY OF THE INVENTION

An object of the present invention is to provide an air cell cushion enabling the seated person to make his seating position stable with less time and less effort.

To achieve the above object, an air cell cushion in accordance with an embodiment according to the present invention, which is to be mounted on a seating surface and support a person seated thereon, comprises a plate-like base member, a plurality of air cells arranged in a horizontal direction and extending upwardly from an upper surface side of the base member, a plurality of side air cells extending upwardly from the upper surface side of the base member at both end sides in a lateral direction of the base member, each side air cell being larger in a front-rear direction size than a lateral direction size, each side air cell having a larger area in the top plan view than an area of each air cell in the top plan view, and each of the plurality of air cells and side air cells connectable with an air volume controller for controlling the air volume in the air cells and the side air cells, each side air cell configured to inflate outwardly in the lateral direction responsive to an increase in the air volume in the side air cell.

By this, the side air cells extend upwardly from the upper surface side of the base member at both end sides in the lateral direction of the base member, and each side air cell has the larger area in the top plan view than the area of each air cell in the top plan view. Also, each side air cell is configured to inflate outside in the lateral direction in response to an increase in the air volume in the side air cell. By this, in a case in which the air cell cushion is mounted on the seating surface of a wheel chair, and the outer side surfaces of the side air cells are facing the armrests of the wheel chair, when the side air cells are inflated outwardly in the lateral direction, the outer side surfaces of the side air cells abut against or become adjacent to the armrests, and regulate that the side air cells fall down toward the outside in the lateral direction. Otherwise, in a case in which the air cell cushion is covered by a cushion cover, when the side air cells are inflated outwardly in the lateral direction, the outer side surfaces of the side air cells abut against or become adjacent to the inner surface of the cushion cover, and regulate that the side air cells fall down toward the outside in the lateral direction. Therefore, it can regulate that air cells located near the side air cells deform in the horizontal direction. Thus, even when each of the air cells is enlarged in the vertical direction to improve the effect for preventing pressure-ulcer, it becomes possible to aim to make the seating position of the seated person stable with less time and less effort.

Also, to achieve the above object, an air cell cushion in accordance with an embodiment of the present invention, which is to be mounted on a seating surface and support a person sitting thereon, comprises a plate-like base member, a plurality of air cells arranged in a horizontal direction and extending upwardly from the upper surface side of the base member, a rear air cell extends upwardly from the upper surface side of the base member at the rear end side of the base member, the rear air cell is larger in the lateral direction size than the front-rear direction size, the rear air cell having a larger area in the top plan view than an area of each air cell in the top plan view, and the air cells and rear air cell connectable with an air volume controller for controlling the air volume in the air cells and the rear air cell, the rear air cell configured to inflate backward in response to an increase in the air volume in the rear air cell.

By this, the rear air cell extends upwardly from the upper surface side of the base member at the rear end side of the base member, and the rear air cell has a larger area in the top plan view than the area of each air cell in the top plan view. Also, the rear air cell is configured to inflate backward responsive to an increase in the air volume in the rear air cell. By this, in a case in which the air cell cushion is mounted on the seating surface of a wheel chair, and the rear side surface of the rear air cell faces the seatback of the wheel chair, when the rear air cell is inflated backward, the rear side surface of the rear air cell abuts against or becomes adjacent to the seatback, and regulates that the rear air cell falls down backward. Otherwise, in a case in which the air cell cushion is covered by a cushion cover, when the rear air cell is inflated backward, the rear side surface of the rear air cell abuts against or becomes adjacent to the inner surface of the cushion cover, and regulates that the rear air cell falls down backward. Therefore, it can regulate that air cells located near the rear air cell deform in the horizontal direction. Thus, even when each of the air cells is enlarged in the vertical direction to improve the effect for preventing pressure-ulcer, it becomes possible to aim to make the seating position of the seated person stable with less time and less effort.

The above and other objects, features, and advantages of the present invention will become more apparent from the following description and the accompanying drawings.

DESCRIPTION OF THE PREFERRED EMBODIMENTS

Figure 1:
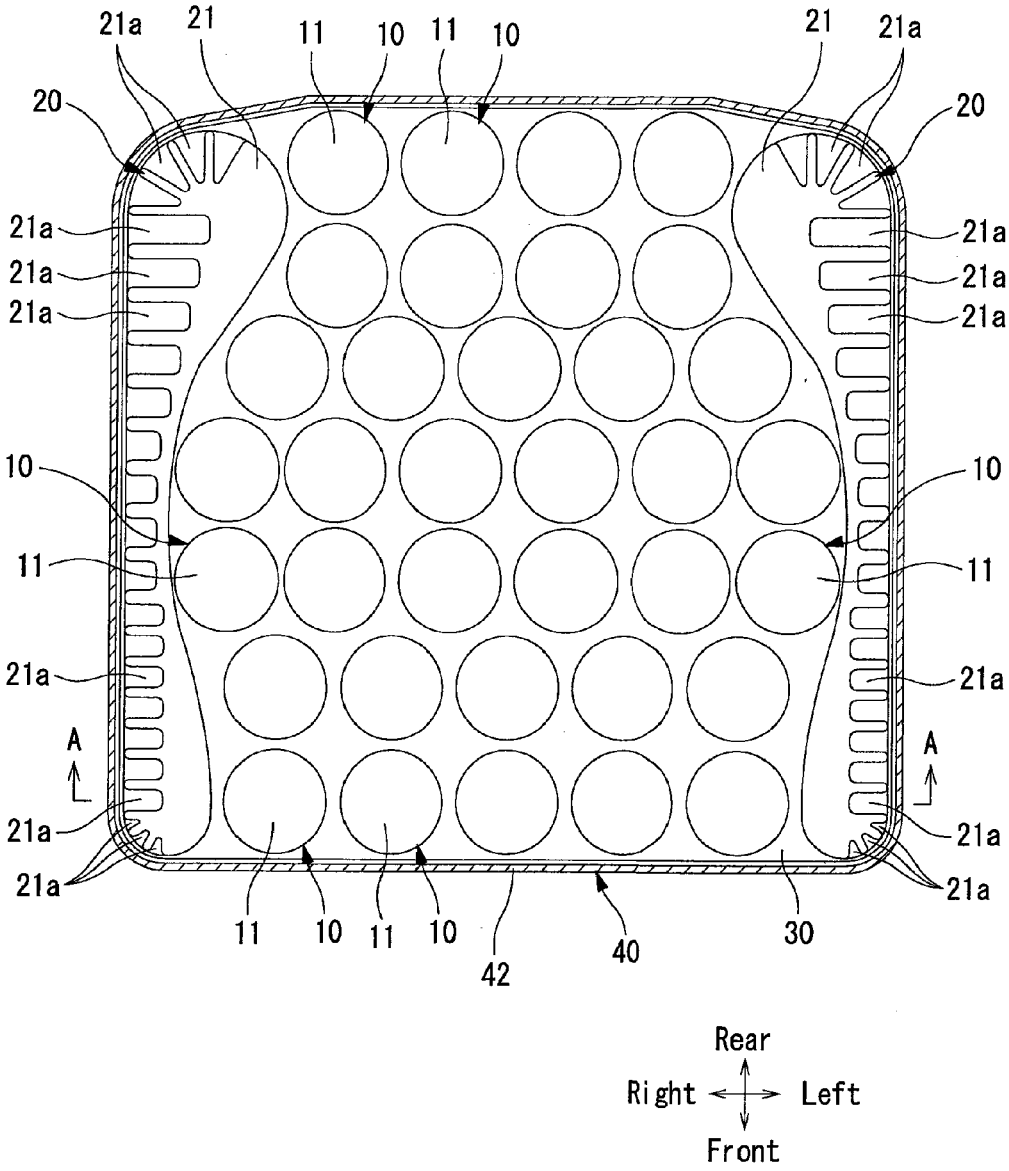
FIG. 1 is a top plan view of an air cell cushion showing a first embodiment of the present invention.

The following describes an air cell cushion of a first embodiment of the present invention regarding FIG. 1 to FIG. 4. The directions described in the following description correspond to the directions shown in FIG. 1 and FIG. 2. Also, the lateral direction described below corresponds to the right and left direction in the drawings.

This air cell cushion comprises a cushion main body 1 having a plurality of air cells 10 arranged in the horizontal direction with respect to each other and for supporting the buttocks of a seated person, a pair of right and left side air cells 20 located at both sides in the lateral direction relative to the group of the air cells 10, each of the side air cells 20 having a larger area than an area of each air cell 10 in the top plan view, each of the side air cells 20 are larger in the front-rear direction size than the lateral direction size, the side air cells 20 for supporting both lateral sides of the buttocks of the seated person, and a base member 30 for supporting each bottom side of the air cells 10 and the side air cells 20, and a cushion cover 40 for covering the cushion main body 1. This cushion is used on the seating surface of a wheel chair, for example.

Each air cell 10 has an air bag 11 in which the bottom end is open, and a bottom member 12 to which the opening end of the air cell 11 is attached. The air bag 11 is made from elastic material such as rubber material or plastic material or the like. The bottom member 12 is made from rubber material or plastic material or the like, the bottom member 12 is provided with a lower protruding portion 12*a* provided on the lower surface thereof, the lower protruding portion 12*a* has a circular cross-section. Also, the bottom member 12 is provided with a groove 12*b* provided on the lower surface of the bottom member 12, and a through hole 12*c* penetrating from the upper surface of the bottom member 12 to the groove 12*b*. The air bag 11 is detachably attached to the bottom member 12 by fitting the outer surface of the upper end side of the bottom member 12 into the opening end of the air bag 11, and by attaching a fitting ring 13 to the outer surface of the opening end of the air bag 11. Also, each air cell 10 is provided with a coil spring 14 and a load sensor 15 using a well-known sheet switch (membrane switch) for detecting the collapse of the air bag 11 to a level at which the air bag 11 can not softly support the buttocks of the seated person.

Each side air cell 20 has an air bag 21 in which the bottom end is open, and a bottom member 22 to which the bottom end of the air bag 21 is glued. The air bag is made from elastic material such as rubber material or plastic material or the like. The bottom member 22 is made from rubber material or plastic material or the like, the bottom member 22 is provided with a plurality of lower protruding portions 22*a* provided on the lower surface thereof, the lower protruding portions 22*a* have a circular cross-section. Also, one of the protruding portion 22*a* is provided with a groove 22*b* provided on the lower surface of the protruding portion 22*a*, and a through hole 22*c* penetrating from the upper surface of the bottom member 22 to the groove 22*b* as well as the bottom member 12 of the air cell 10.

Figure 3:
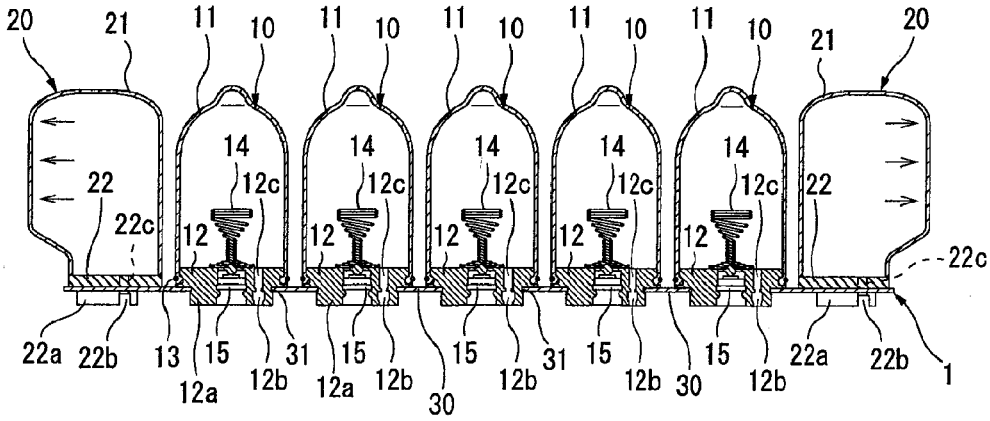
FIG. 3 is a sectional view of the cushion main body showing a state in which each side air cell is inflated.
Figure 4:
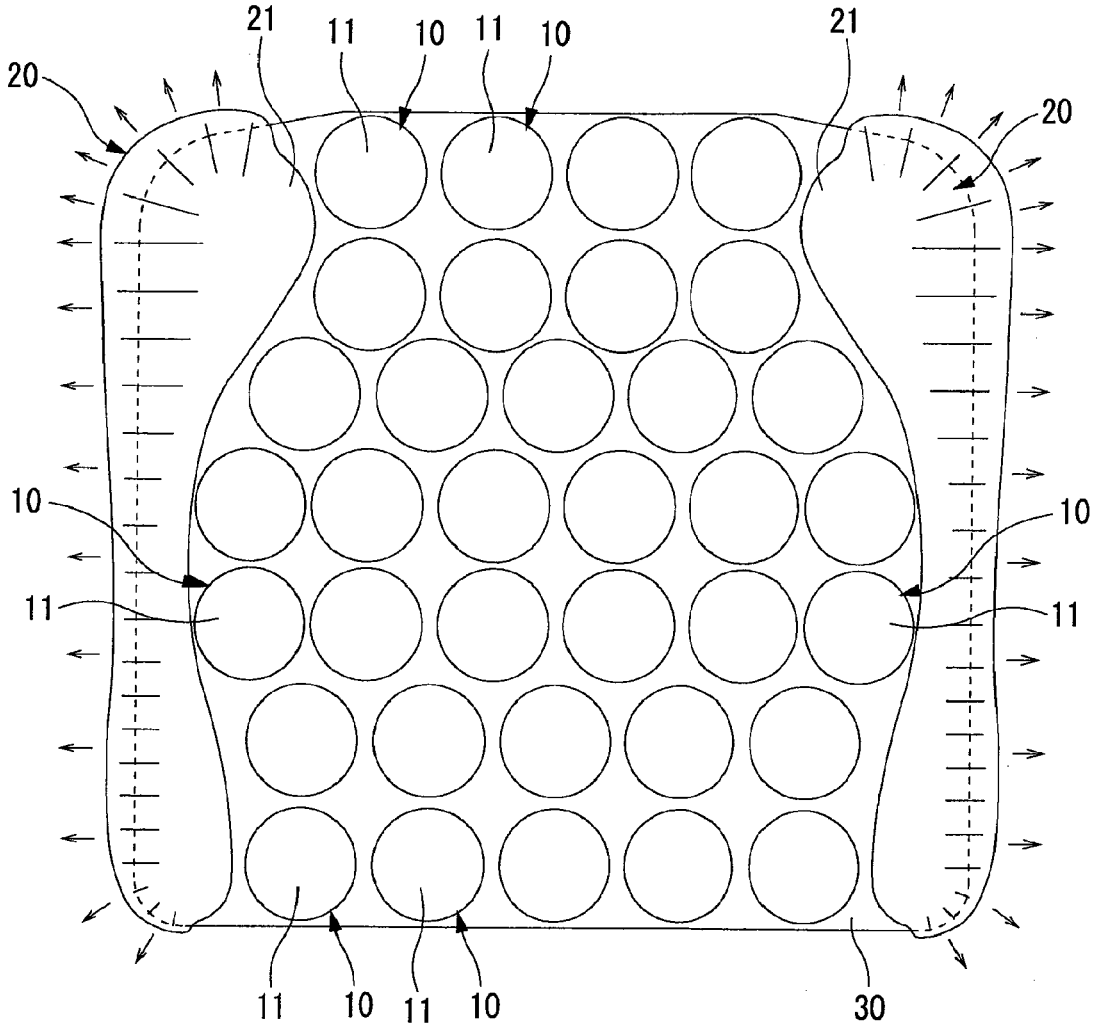
FIG. 4 is a top plan view of the cushion main body showing the state in which each side air cell is inflated.

Each air bag 21 has a plurality of dented portions 21*a* provided on the outer side surface thereof in the lateral direction, on the rear side surface thereof, and on the front side surface thereof in a state in which the air bag 21 is not inflated. The dented portions 21*a* are provided by forming a plurality of portions of the side surface which are spaced with respect to each other in the front-rear direction or the lateral direction so as to protrude toward the inside of the side air cell 20. The portions are formed in a predetermined vertical direction area of the air bag 21. Also, as shown in FIGS. 3 and 4, if the amount of air in the side air cell 20 becomes large, an area of the air bag 21 of the side air cell 20 where the dented portions 21*a* are provided is inflated toward the outside in the lateral direction and front and rear side thereof.

Figure 2:
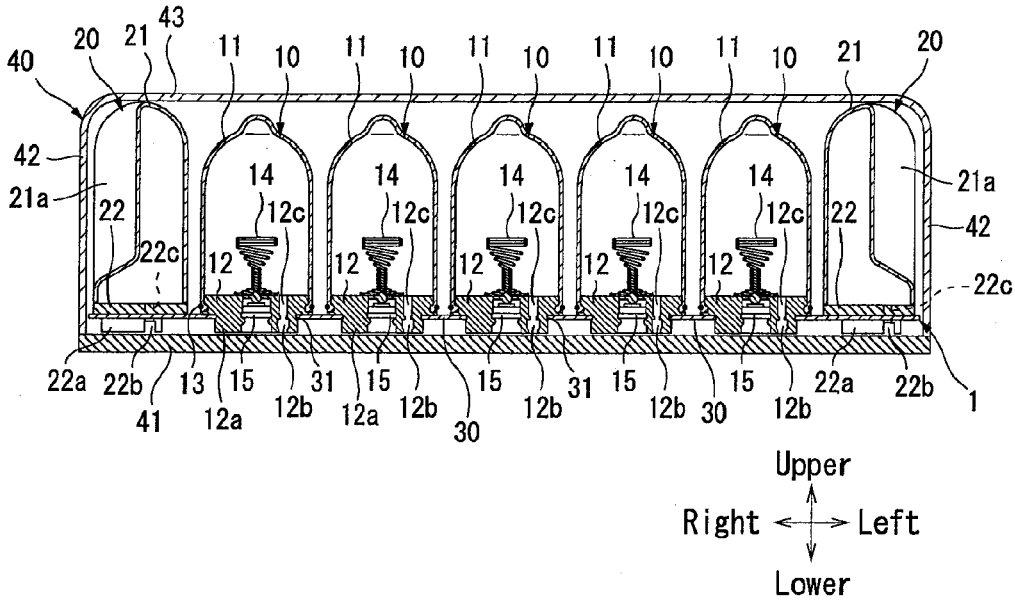
FIG. 2 is an A-A sectional view of the FIG. 1.

The base member 30 is made from rubber material or plastic material or the like, and formed to a plate-like shape. The base member 30 is provided with a plurality of installation holes 31, each of the installation holes 31 penetrates the base member 31 in the vertical direction. The lower protruding portions 12*a*, 22*a* of the air cells 10, 20 are inserted into the installation holes 31 from the upper side and detachably attached to the installation holes 31. By this, the bottom end sides of each of the air cells 10, 20 are supported by the base member 30. Therefore, each of the air cells 10, 20 is provided so as to extend upwardly from the upper surface side of the base member 30. Also, as shown in FIG. 2, each of the side air cells 20 is provided so as to extend upwardly from the upper surface side of the base member at both end sides in the lateral direction of the base member.

Elastic pipes (not shown in the drawings) are fitted into each of the grooves 12*b*, 22*b* of the bottom members 12, 22 of the air cells 10, 20, and each of the pipes is connected to the through holes 12*c*, 22*c*. Also, each of the air cells 10, 20 is connected to an air volume controller (not shown in the drawings) via the pipes, the air volume in each of the air cells 10, 20 is controlled by the air volume controller. The air volume controller is composed using a well-known electric air pump, electromagnetic valve, etc. The air volume controller can control the air volume in the air cells 10 and the air volume in the side air cells 20, respectively, and the volume controller can control the air volume in the left side air cell 20 and the right side air cell 30, respectively.

The cushion cover 40 has a cover bottom surface 41 to cover the bottom surface of the cushion main body 1, a cover side portion 42 to cover the side of the group of the air cells of the cushion main body 1, and a cover upper portion 43 to cover the group of the air cells of the cushion main body 1.

The cover bottom surface 41 can be made of a textile material made from polyester fiber, nylon fiber, urethane fiber, etc., or can be made of a plate-like member made from rubber material, plastic material, thermoplastic elastomer, etc. The cover bottom surface 41 can also be made from other members.

The cover side portion 42 and the cover upper portion 43 are made of a textile material made from polyester fiber, nylon fiber, urethane fiber, etc., or can be made of other elastic members. The cover side portion 42 extends upwardly from the periphery of the cover bottom surface 41, and covers circumferentially the side of the cushion main body 1. The bottom end of the cover side portion 42 is fixed to the periphery of the cover bottom surface 41. The cover side portion 42 is provided with a fastener (not shown in the drawings), the cushion main body 1 is inserted in or taken out through the fastener.

The air cell cushion described above is used to support the buttocks and femur of the seated person. The air amount of the air cells 10, 20 of the air cell cushion is automatically controlled by the air volume controller.

Also, in this air cell cushion, air cells 10 support buttocks of the seated person and side air cells 20 support both lateral sides of the buttocks of the sitting person. The air bags 11, 21 of the air cells 10, 20 deform softly in the vertical and horizontal directions.

Also, a pair of right and left side air cells 20 extend upwardly from the upper surface side of the base member 30 at both end sides in the lateral direction of the base member 30, each side air cell 20 is such that the front-rear direction size is larger than the lateral direction size. Also, each side air cell 20 is configured to inflate toward the outside in the lateral direction and front and rear side thereof when the air volume in the side air cell 20 becomes large by the air volume controller. Therefore, in a case in which the lateral outer side surfaces of the side air cells face he armrests of the wheel chair, when the side air cells 20 are inflated outward in the lateral direction, the lateral outer side surfaces of the side air cells abut against or become adjacent to the armrests, and it can regulate that the side air cells 20 fall down toward the outside in the lateral direction.

As described above, by this embodiment, inflating the side air cells 20 regulates deformation of the side air cells 20 in the lateral direction. Therefore, the air cells located near the side air cells 20 are regulated from deforming in the horizontal direction. Thus, even when each of the air cells 10, 20 is enlarged in the vertical direction to improve the effect of preventing pressure-ulcer, it becomes possible to aim to make the seating position of the seated person stable with less time and less effort.

The air bag 21 of each of the side air cells 20 has a plurality of dented portions 21*a* provided on the lateral outer side surface thereof in a state in which the air bag 21 is not inflated. The dented portions 21*a* are provided by forming a plurality of portions of the said side surface which are spaced apart from each other in the front-rear direction and protruding inward of the side air cell 20. By this, when the amount of air in the side air cell 20 becomes large, the area of the air bag 21 of the side air cell 20 where the dented portions 21*a* are provided is inflated outward in the lateral direction.

The air bag 21 of each of the side air cells 20 also has a plurality of dented portions 21*a* provided on the rear side surface and front side surface thereof in a state in which the air bag 21 is not inflated. Also, when the amount of air in the side air cell 20 becomes large, the area of the air bag 21 of the side air cell 20 where the dented portions 21*a* are provided is inflated toward rear and front sides thereof. In this case, as shown in FIGS. 3 and 4, when each side air cell 20 is inflated, the rear sides of the air cells 20 protrude backward relative to the base member 30. Therefore, if the rear side surfaces of the side air cells 20 face the seatback of the wheel chair, the rear side surfaces of the side air cells 20 abut against or become adjacent to the seatback, and regulate the deformation of the rear air cells in the lateral direction or front-rear direction.

Also, in this embodiment, the cushion main body 1 is covered by the cushion cover 40. Therefore, even if the lateral outer side surfaces of the side air cells 20 are not abutting against or adjacent to the armrests of the wheel chair, when the air bags 21 of the side air cells 20 are inflated outwardly in the lateral direction, the lateral outer side surfaces of the air bags 21 of the side air cells 20 abut against the inner surface of the cushion cover 40, and the deformation of the side air cells 20 in the lateral direction will be regulated. Therefore, it can regulate that air cells located near side air cells 20 deform in the horizontal direction. Thus, even when each of the air cells 10, 20 is enlarged in the vertical direction to improve the effect for pressure-ulcer, it becomes possible to aim to make the seating position of the seated person stable with less time and less effort.

Also, the air bag 21 has a plurality of dented portions 21*a* on the front and rear sides thereof in the non-inflated state. Therefore, air bags 21 of the side air cells 20 are inflated toward the front and rear direction, and the front and rear side surfaces of the air bags 21 of the air cells 20 abut against the inner surface of the cushion cover 40. Therefore, it can regulate each air cell 20 from deforming in the lateral and front-rear direction.

In this embodiment, a pair of side air cells 20 is provided at both lateral end sides of the base member 30. On the other hand, it is possible to provide several pairs of side air cells 20 at both lateral end sides of the base member 30. In this case, if each of the side air cells 20 has a larger area in the plan view than an area of each air cell 10 in the plan view, and each side air cell 20 has a larger size in the front-rear direction than that in the lateral direction, and each of the side air cells 20 is provided in the vicinity of the periphery of the base member, and each of the side air cells 20 has a plurality of dented portions 21*a* on the lateral outer side, it is possible to achieve the effect mentioned above.

In this embodiment, each of the air cells 20 is provided at both lateral end sides of the base member 30. On the other hand, it is possible to provide a rear air cell at the rear end side of the base member 30. In this case, the rear air cell has a larger lateral size than a front-rear direction size thereof, and has a larger area in the plan view than the area of each of the air cells 10. Also, it is possible to provide a plurality of dented portions on the rear side thereof like the dented portions 21*a* provided on the side air cells 20. By this, if the air volume in the rear air cell becomes large, the rear side of the rear air cell is inflated backward. Also, in the case in which the rear side surface of the rear air cell faces the seatback of the wheel chair, the rear side surface of the rear air cell abuts against or becomes adjacent to the seatback, and it can regulate that the rear air cell falls down backward. Otherwise, since this air cell cushion is covered by the cushion cover 40, even if the rear side surface of the rear air cell is not abutting against or adjacent to the seatback of the wheel chair, when the rear air cell is inflated backward, the rear side surface of the rear air cell abuts against the inner surface of the cushion cover 40, and it regulates that the rear air cell falls down backward. Therefore, it can regulate that air cells located near the rear air cell deform in the horizontal direction. Thus, even when each of the air cells 10, 20 is enlarged in the vertical direction to improve the effect for preventing pressure-ulcer, it becomes possible to aim to make the seating position of the seated person stable with less time and less effort.

In this embodiment, each of the air cells 10, 20 is configured apart from the base member 30. On the other hand, it is possible to configure each of the air cells 10, 20 and the base member 30 in one form by dipping procedure or the like which is usually used to form air cell cushions, and it can also achieve the effect described above.

The preferred embodiments described in this specification are illustrative and not restrictive. The scope of invention is given by the appended claims, and all changes and modifications included in the meaning of claims are embraced in the present invention.

The invention claimed is:

1. An air cell cushion to be mounted on a seating surface and support a person seated thereon, the air cell cushion comprising:

a plate-like base member;

a plurality of air cells arranged in a horizontal direction and extending upwardly from an upper surface side of the base member; and a plurality of side air cells extending upwardly from the upper surface side of the base member at both end sides in a lateral direction of the base member, each side air cell being larger in a front-rear direction size than a lateral direction size, wherein each side air cell has a larger area in the top plan view than an area of each air cell in the top plan view, each of the plurality of air cells and side air cells is connectable with an air volume controller for controlling the air volume in the air cells and the side air cells, each side air cell is configured to inflate outwardly in the lateral direction responsive to an increase in the air volume in the side air cell, and each of the side air cells has a plurality of dented portions on an outer side surface thereof in the lateral direction in a state in which the side air cell is not inflated, the dented portions being a plurality of portions of said outer side surface spaced apart from each other in the front-rear direction and protruding inward of the side air cell.

2. The air cell cushion according to claim 1, further comprising the air volume controller connected with the air cells and the side air cells.

3. An air cell cushion to be mounted on a seating surface and support a person seated thereon, the air cell cushion comprising:

a plate-like base member;

a plurality of air cells arranged in a horizontal direction and extending upwardly from an upper surface side of the base member; and a rear air cell extending upwardly from the upper surface side of the base member at a rear end side of the base member, the rear air cell being larger in size in a lateral direction than a front-rear direction, the rear air cell having a larger area in the top plan view than an area of each air cell in the top plan view, wherein each of the plurality of air cells and rear air cells is connectable with an air volume controller for controlling the air volume in the air cells and the rear air cell, the rear air cell is configured to inflate backward in response to an increase in the air volume in the rear air cell, and the rear air cell has a plurality of dented portions on a rear side surface thereof in a state in which the rear air cell is not inflated, the dented portions being a plurality of portions of said rear side surface spaced apart from each other in the lateral direction and protruding into the interior of the rear air cell.

4. The air cell cushion according to claim 1, further comprising a cover bottom surface supporting the air cell and the side air cell, wherein each side air cell is configured to inflate outwardly and beyond a peripheral edge of the cover bottom surface in the lateral direction responsive to the increase in the air volume in the side air cell.

5. The air cell cushion according to claim 1, wherein each air cell of the plurality of air cells and each of the side air cells are directly connectable with the air volume controller.

6. The air cell cushion according to claim 1, wherein a height of each side air cell is greater than that of each air cell in a state in which the side air cell is not inflated.

7. The air cell cushion according to claim 6, wherein the height of each side air cell is reduced to be less than that of each air cell in a state in which the side air cell is inflated.

8. The air cell cushion according to claim 3, further comprising the air volume controller connected with the air cells and the rear air cell.

* * * * *